US005821904A

United States Patent [19]

Kakizawa et al.

[11] Patent Number: 5,821,904

[45] Date of Patent: Oct. 13, 1998

[54] WINDOW GLASS ANTENNA DEVICE

[75] Inventors: Hitoshi Kakizawa; Yoshinori Matsuoka; Ryokichi Doi, all of Osaka, Japan

[73] Assignee: Nippon Sheet Glass Co., Ltd., Osaka, Japan

[21] Appl. No.: 672,406

[22] Filed: Jun. 28, 1996

[30] Foreign Application Priority Data

Jun. 28, 1995 [JP] Japan ..... 7-162229

[51] Int. Cl.[6] ..... H01Q 1/32

[52] U.S. Cl. ..... 343/704; 343/713

[58] Field of Search ..... 343/704, 712, 343/713, 856, 858; H01Q 1/32

[56] References Cited

U.S. PATENT DOCUMENTS 1,597,379 8/1926 Kolster ..... 343/858
4,791,426 12/1988 Lindenmeier et al. ..... 343/713
5,083,134 1/1992 Saitou et al. ..... 343/713
5,177,495 1/1993 Davies ..... 343/713
5,331,271 7/1994 Thuis ..... 343/745
5,334,988 8/1994 Murakami et al. ..... 343/704

*Primary Examiner*—Donald T. Hajec
*Assistant Examiner*—Tho Phan
*Attorney, Agent, or Firm*—Merchant, Gould, Smith, Edell, Welter & Schmidt

[57] ABSTRACT

A window glass antenna device disposed on an automobile window glass panel has a dedicated antenna disposed on the automobile window glass panel, a heater antenna comprising a defroster heater pattern disposed on the automobile window glass panel, and a feeder cable for transmitting received signals from the dedicated antenna and the heater antenna. An impedance transformer for effecting an impedance conversion between the dedicated antenna and the heater antenna, and the feeder cable has a primary winding having an end connected to the dedicated antenna, the primary winding having a tap connected to the heater antenna, and a secondary winding connected to the feeder cable.

7 Claims, 4 Drawing Sheets

WINDOW GLASS ANTENNA DEVICE

BACKGROUND OF THE INVENTION

1. Field of the Invention

The present invention relates to a window glass antenna device having antennas disposed on an automobile window glass panel for receiving radio and television broadcasting waves.

2. Description of the Related Art

Conventional window glass antenna devices have a heater antenna disposed on an automobile window glass panel and doubling as defroster heater lines, and a dedicated antenna disposed on the automobile window glass panel and capacitively coupled to the heater antenna. It is known in the art that in order to prevent the reception sensitivity of the antennas from being lowered, a choke coil is connected between bus bars joined to the heater lines and a DC power supply which supplies an electric current to heat the heater lines. The choke coil serves to provide an increased impedance with respect to an AM radio frequency band for increasing the reception sensitivity of the antennas.

FIG. 1 of the accompanying drawings shows a conventional window glass antenna device.

As shown in FIG. 1, the conventional window glass antenna device comprises defroster heater lines 54 disposed as a heater antenna on an automobile window glass panel 51, and a dedicated antenna 52 disposed on an upper area of the automobile window glass panel 51 above the defroster heater lines 54, the dedicated antenna 52 having a feeder terminal 52*a* at one end thereof. The dedicated antenna 52 comprises a conductive pattern positioned a short distance from and capacitively coupled to the defroster heater lines 54. A bus bar assembly 53 includes a pair of spaced bus bars 53*a*, 53*b* connected to respective opposite ends of the defroster heater lines 54.

The feeder terminal 52*a* is connected to a core 55*a* of a feeder cable 55, which has an outer conductive tube 55*b* connected to an automobile body.

A broadcasting signal received by the defroster heater lines 54 is transmitted to the dedicated antenna 52 through the capacitive coupling between the defroster heater lines 54 and the dedicated antenna 52.

A broadcasting signal received directly by the dedicated antenna 52 is combined with the broadcasting signal transmitted from the defroster heater lines 54, and supplied through the feeder terminal 52*a* and the feeder cable 55 to an external receiver (not shown) connected to the feeder cable 55.

A DC power supply PS has positive and negative terminals between which there is connected a capacitor C for absorbing noise generated in power supply lines connected to the DC power supply PS. The positive and negative terminals are connected through a choke coil CH having an inductance of 1 mH, for example, to the bus bars 53*a*, 53*b*, respectively.

A current for heating the defroster heater lines 54 is supplied from the positive terminal of the DC power supply PS through the choke coil CH and the bus bar 53*a* to the defroster heater lines 54, and then flows from the defroster heater lines 54 through the bus bar 53*b* and the choke coil CH back to the negative terminal of the DC power supply PS.

The choke coil CH serves to substantially increase an AC impedance ($=2\pi fL$ where f is the frequency and L is the coil inductance) of the defroster heater lines 54 in an Am frequency band ranging from 500 to 1700 kHz.

Since the AC impedance of the defroster heater lines 54 is increased by the choke coil CH, the electric energy of the broadcasting signal received by the defroster heater lines 54 is prevented from flowing through the bus bar assembly 53 and from being unduly consumed by the DC power supply PS which has a low impedance, Accordingly, the reception sensitivity of the defroster heater lines 54 is prevented from being unduly lowered.

Stated otherwise, the choke coil CH for providing an increased AC impedance with respect to the AM frequency band is connected between the bus bar assembly 53 and the DC power supply PS which supplies a current to heat the defroster heater lines 54 for preventing the reception sensitivity of the defroster heater lines 54 from being reduced.

The choke coil CH needs to have a large current handling capacity for withstanding a current of several tens of amperes to heat the defroster heater lines 54, and is also required to have a large inductance to provide a substantially increased impedance with respect to the AM frequency band. Therefore, the choke coil CH is relatively large in size and needs a relatively large installation space within a limited space available on the automobile.

Furthermore, the large-size choke coil CH, including its outer casing, incurs an increase in the cost of materials used, and is expensive to manufacture.

SUMMARY OF THE INVENTION

It is therefore an object of the present invention to provide a window glass antenna device which requires no choke coil and has a required level of signal reception sensitivity.

According to the present invention, there is provided a window glass antenna device comprising an automobile window glass panel, a dedicated antenna disposed on the automobile window glass panel, a heater antenna comprising a defroster heater pattern disposed on the automobile window glass panel, a feeder cable for transmitting received signals from the dedicated antenna and the heater antenna, and an impedance transformer for effecting an impedance conversion between the dedicated antenna, the heater antenna, and the feeder cable, the impedance transformer comprising a primary winding having an end connected to the dedicated antenna, the primary winding having a tap connected to the heater antenna, and a secondary winding connected to the feeder cable.

A DC-blocking capacitor is connected between the tap and the heater antenna. The impedance transformer comprises a toroidal core of ferrite, the primary winding comprising a predetermined number of turns wound on the toroidal core, the secondary winding comprising a predetermined number of turns wound on the toroidal core. The ratio of the number of turns of the primary winding to the number of turns of the secondary winding is 4:1. The primary winding has an opposite end connected to the secondary winding, and the ratio of the number of turns of the primary winding between the end thereof and the tap to the number of turns of the primary winding between the tap and the opposite end is 15:1.

The window glass antenna device further comprises a pair of feeder lines extending from the secondary winding along a side edge of the automobile window glass panel and connected to the feeder cable.

The above and further objects, details and advantages of the present invention will become apparent from the following detailed description of preferred embodiments thereof, when read in conjunction with the accompanying drawings.

DETAILED DESCRIPTION OF THE PREFERRED EMBODIMENTS

Figure 2:
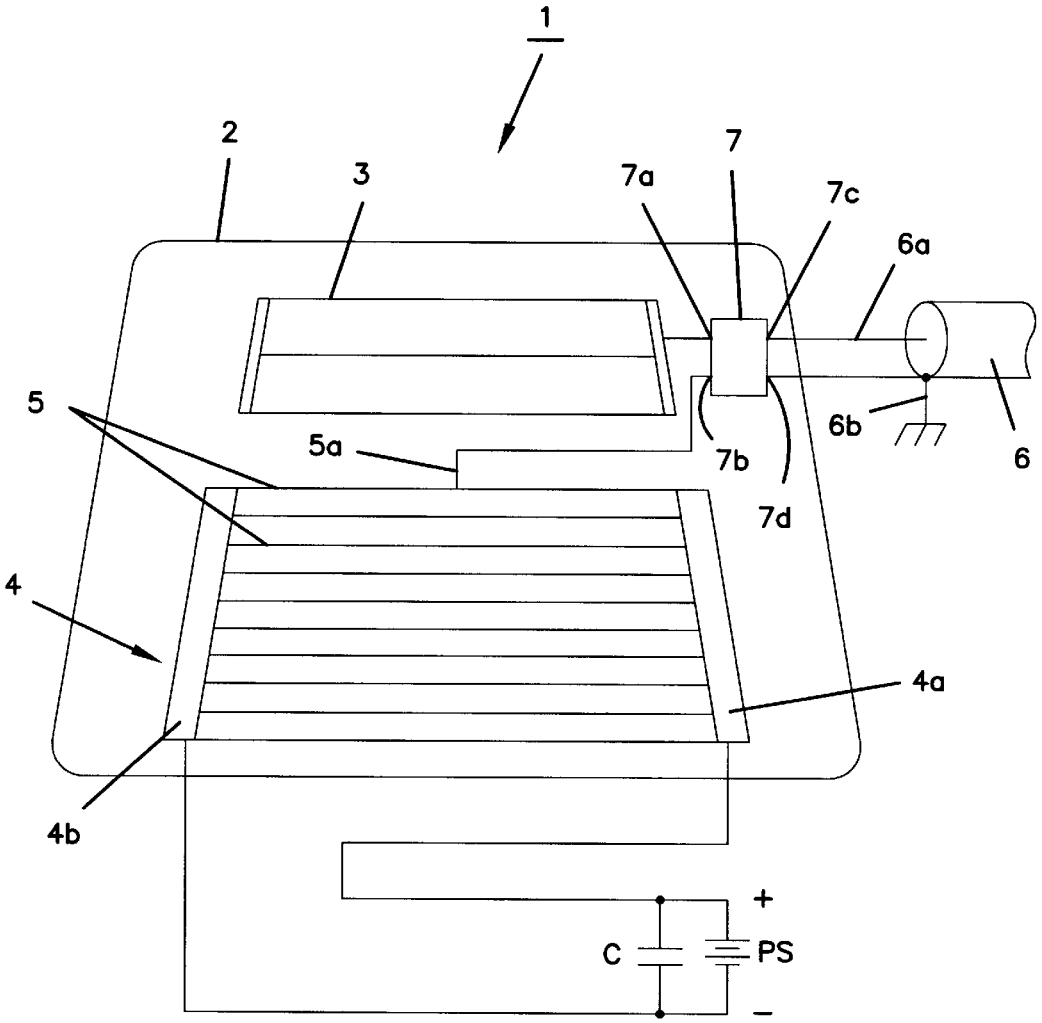
FIG. 2 is a schematic plan view of a window glass antenna device according to an embodiment of the present invention.

As shown in FIG. 2, a window glass antenna device 1 according to an embodiment of the present invention has a dedicated antenna 3 disposed on a window glass panel 2 and comprising a conductive pattern, a lead line 5*a* disposed on the window glass panel 2 and comprising a conductive pattern, and defroster heater lines 5 disposed on the window glass panel 2 as a heater antenna and connected to a bus bar assembly 4 which comprises a pair of spaced bus bars 4*a*, 4*b* on the window glass panel 2.

Each of the conductive patterns of the dedicated antenna 3 and the lead line 5*a* comprises a conductive metal filament, strip, or foil which is formed by printing a conductive paste, comprising fine particles of silver and a powder of glass of a low melting point which are dissolved in an organic solvent, on the window glass panel 2 by way of screen printing, and then baking the printed conductive paste layer.

The defroster heater lines 5 comprises thin nichrome wires or are formed by printing a conductive paste of silver on the window glass panel 2 by way of screen printing, and then baking the printed silver paste layer. The defroster heater lines 5 are supplied with a heating current from a DC power supply PS, which may comprise an automobile battery, for example, through the bus bar assembly 4. A capacitor C for absorbing noise is connected between positive and negative terminals of the DC power supply PS.

Figure 3:
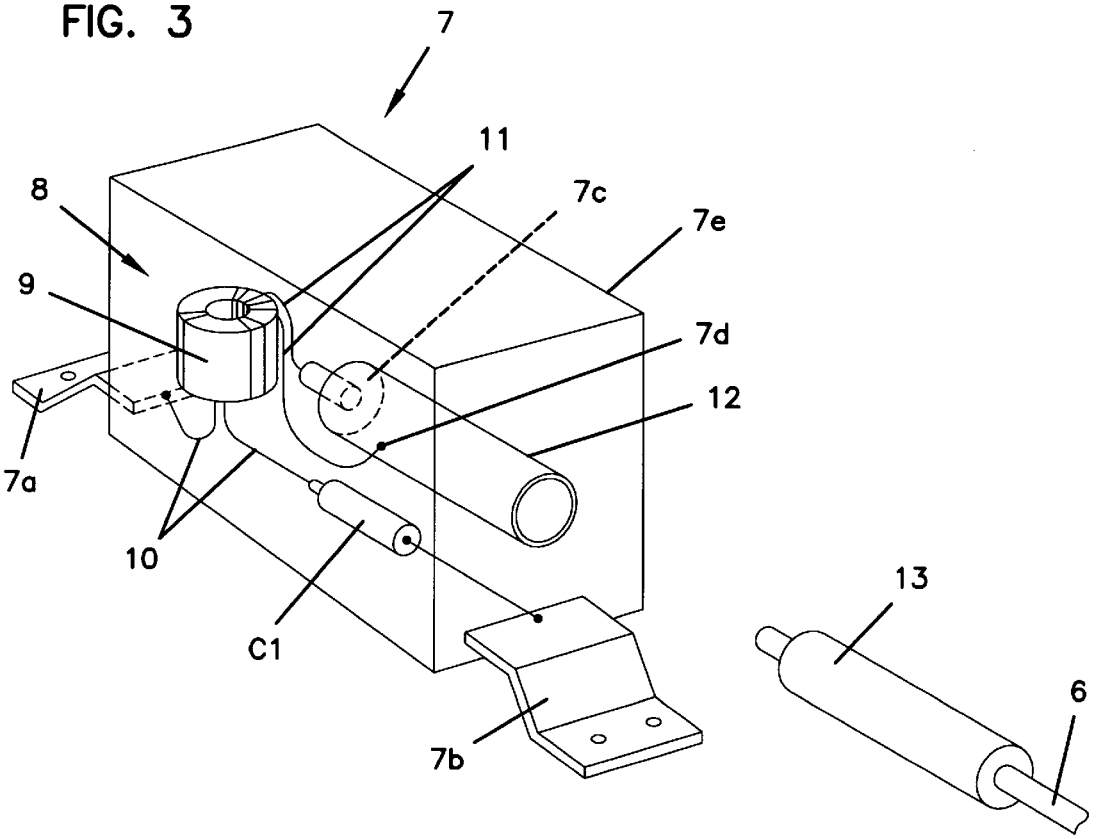
FIG. 3 is a perspective view of an impedance transformer of the window glass antenna device shown in FIG. 2.
Figure 4:
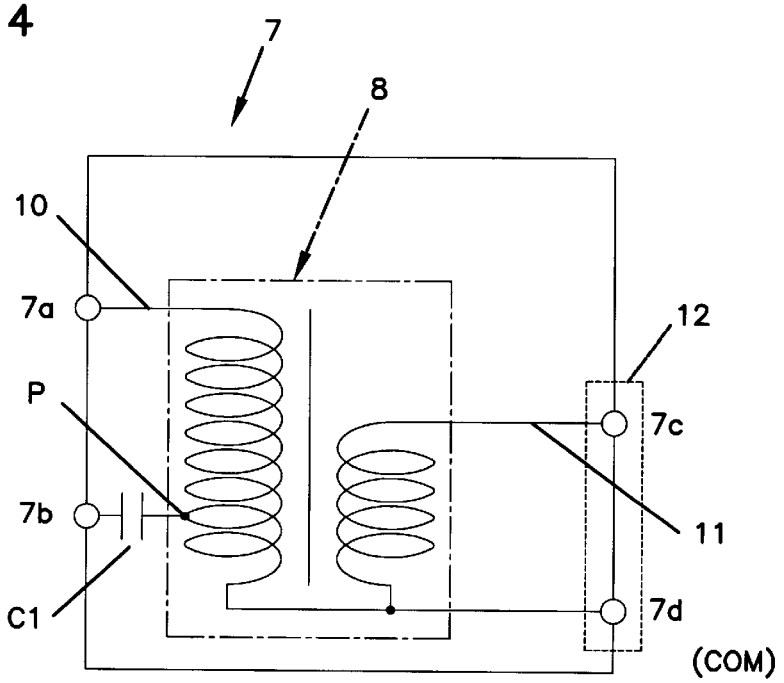
FIG. 4 is a circuit diagram of the impedance transformer shown in FIG. 3.

The window glass antenna device 1 also has an impedance transformer unit 7 which includes an impedance transformer 8 (see FIGS. 3 and 4). As shown in FIGS. 3 and 4, the impedance transformer B has a primary winding 10 and a secondary winding 11. The primary winding 10 has terminals 7*a*, 7*b* connected to the dedicated antenna 3 and the lead line 5*a*. The secondary winding 11 has terminals 7*c*, 7*d* connected to a core 6*a* and outer conductive tube 6*b*, respectively, of a feeder cable 6 at an upper position of the window glass panel 2, the outer conductive tube 6*b* being connected to an automobile body.

The dedicated antenna 3 will have a higher gain for a better signal reception sensitivity if the capacity of the dedicated antenna 3 is greater compared with the capacity of the feeder cable 6.

A signal received by the dedicated antenna 3 which serves as an AM antenna is transmitted to the terminal 7*a* of the impedance transformer unit 7. The signal reception sensitivity of the dedicated antenna 3 is increased by the impedance transformer unit 7 that converts an impedance between the dedicated antenna 3 and the feeder cable 6. The inclusion of the impedance transformer unit 7 is effective to reduce the capacity of the feeder cable 6 as seen from the dedicated antenna 3 for a reduced transmission loss. Stated otherwise, the inclusion of the impedance transformer unit 7 increases the capacity of the dedicated antenna 3 as seen from the feeder cable 6.

A signal received by the defroster heater lines 5 which serve as an AM/FM antenna is transmitted through the lead line 5*a* to the terminal 7*b* of the impedance transformer unit 7 that converts an impedance between the defroster heater lines 5 and the feeder cable 6.

The received signals transmitted from the dedicated antenna 3 and the defroster heater lines 5 to the impedance transformer unit 7 are then supplied as a combined received signal in an AM/FM band from the impedance transformer unit 7 through the feeder cable 6 to an external receiver (not shown) connected thereto.

Lowering the antenna impedance of the dedicated antenna 3 is effective to increase the signal reception sensitivity thereof. For lowering the antenna impedance of the dedicated antenna 3, it is preferable to increase the size and length of the conductive pattern of the dedicated antenna 3 as much as possible for thereby increasing the capacity of the dedicated antenna 3. To this end, the dedicated antenna 3 may comprise a flat transparent conductive pattern rather than a filamentary conductive pattern.

It is generally desirable that the capacity of the feeder cable 6 be small for the purpose of increasing the signal reception sensitivity. With the impedance transformer unit 7 included, however, a higher signal reception sensitivity is achieved if capacity of the feeder cable 6 is larger.

As described above, the window glass antenna device 1 according to this embodiment has the impedance transformer 7 rather than a choke coil for converting impedances between the dedicated antenna 3 and the feeder cable 6 and also between the defroster heater lines 5 and the feeder cable 6. Therefore, the window glass antenna device 1 has a good signal reception sensitivity.

Structural details of the impedance transformer unit 7 are shown in FIG. 3.

AS shown in FIG. 3, the impedance transformer unit 7 also includes a DC-blocking capacitor C1 having an end connected to the primary winding 10. The impedance transformer 8 has a core 9 on which the primary winding 10 and the secondary winding 11 are wound. The impedance transformer unit 7 also has a female coaxial connector 12 comprising a core coupled to the terminal 7*c* and an outer conductive tube coupled to the terminal 7*d*. The core of the female coaxial connector 12 is connected to the core 6*a* of the feeder cable 6, and the outer conductive tube of the female coaxial connector 12 is connected to the outer conductive tube 6*b* of the feeder cable 6, through a male coaxial connector 13 which is inserted in the female coaxial connector 12.

The terminal 7*a* is coupled to the primary winding 10, the other end of the capacitor C1 is connected to the terminal 7*b*, and the ends of the secondary winding 11 are connected to the core and outer conductive tube of the coaxial connector 12. The impedance transformer 8, the capacitor C1, and the coaxial connector 12, and the terminals 7*a*, 7*b* are sealingly encased in a case 7*e* of insulating synthetic resin.

The core 9 of the impedance transformer 8 comprises a toroidal core of ferrite. The primary winding 10 comprises a predetermined number of turns of an enamel or formal wire, and the secondary winding 11 also comprises a predetermined number of turns of an enamel or formal wire. The capacitor C1 is connected to a certain tap of the primary winding 10.

The numbers of turns of the primary and secondary windings 10, 11 are determined primarily depending on the impedance of the dedicated antenna 3 connected to the terminal 7*a*, the impedance of the feeder cable 6 connected between the terminals 7*c*, 7*d*, and the frequency bands of received signals.

For example, if the feeder cable 6 has an impedance of 50 Ω and a capacitance of 120 pF and the window glass antenna device 1 is to receive AM/FM radio broadcast signals, then the ratio between the numbers of turns of the primary and secondary windings 10, 11 is determined to match the impedances of the dedicated antenna 3 and the feeder cable 6 for thereby achieving an optimum signal reception sensitivity.

Based on the results of cut-and-dried experimentation, the ratio of the number of turns of the primary winding 10 to the number of turns of the secondary winding 11 should preferably be set to a value of 4:1 which leads to a signal reception sensitivity free of any practical problems.

The capacitor C1 is connected to such a tap of the primary winding 10 as to achieve a impedance match between the junction connected to the defroster heater lines 5 and the secondary winding 11 connected to the feeder cable 6 for an optimum signal reception sensitivity. Based on the results of cut-and-dried experimentation, the tap should preferably be positioned which divides the primary winding 10 at a ratio of 15:1 (described in detail later on) which leads to a signal reception sensitivity free of any practical problems.

In order to reduce a transmission loss which received signals are subject to by the impedance transformer 8, the wires of the windings 10, 11 on the core 9 may be reduced in diameter, or the core 9 may be of an increased magnetic permeability, so that each of the windings 10, 11 may comprise a reduced number of turns.

The terminals 7*a* , 7*b* are connected to the dedicated antenna 3 and the lead line 5*a* by soldering, for example. A received signal from the dedicated antenna 3 is transmitted through the terminal 7*a* to the primary winding 10, and a received signal from the defroster heater lines 5 is transmitted through the terminal 7*b* and the capacitor C1 to the primary winding 10. These received signals are then transmitted as a combined received signal to the secondary winding 11 which is electromagnetically coupled to the primary winding 10.

The combined received signal is then transmitted from the terminals 7*c*, 7*d* to the feeder cable 6 through the female coaxial connector 12 and the male coaxial connector 13 that is fitted in the female coaxial connector 12.

In this embodiment, the DC-blocking capacitor C1 is incorporated in the impedance transformer unit 7. However, if the DC power supply PS is not grounded to the automobile body, then the DC-blocking capacitor C1 may be dispensed with because a current supplied from the DC power supply PS to heat the defroster heater lines 5 does not flow into the impedance transformer 8.

Instead of the coaxial connector 12, a terminal plate may project out of the case 7*e*, and the core 6*a* and outer conductive tube 6*b* of the feeder cable 6 may be connected directly to the terminal plate.

As described above, the impedance transformer unit 7 with the impedance transformer 8 effects an impedance conversion between the dedicated antenna 3 and the defroster heater lines (heater antenna) 5, and the feeder cable 6 for thereby increasing the signal reception sensitivity.

FIG. 4 shows in block form the impedance transformer unit 7 according to this embodiment.

As shown in FIG. 4 the impedance transformer unit 7 has its primary and secondary windings 10, 11 wound in predetermined numbers of turns on the core 9 (see FIG. 3) such that the ratio between the number of turns of the primary winding 10 (between the terminal 7*a* and the terminal 7*d* (COM)) and the number of turns of the secondary winding 11 (between the terminal 7*c* and the terminal 7*d* (COM)) is set to a value of 4:1. The primary and secondary windings 10, 11 have ends connected to each other and also to the terminal 7*d* (COM).

The primary winding 10 has a tap P at such a position where the ratio of the number of turns between the terminal 7*a* and the tap P to the number of turns between the tap P and the terminal 7*d* (COM) is 15:1 as described above with reference to FIG. 3. The DC-blocking capacitor C1 is connected at one end thereof to the terminal 7*b* and at the other end thereof to the tap P.

The terminal 7*b* is connected to the lead line 5*a* which extends from a central position on an uppermost defroster heater line 5 shown in FIG. 2. The terminal 7*b* is thus supplied with a signal that is received by the defroster heater lines 5 serving as an antenna.

The capacitor C1 passes only the received signal from the defroster heater lines 5, and blocks a current supplied from the DC power supply PS for heating the defroster heater lines 5.

If the DC power supply PS is not grounded to the automobile body, the capacitor C1 may be dispensed with, as described above, and the terminal 7*b* may be connected directly to the tap P.

Figure 5:
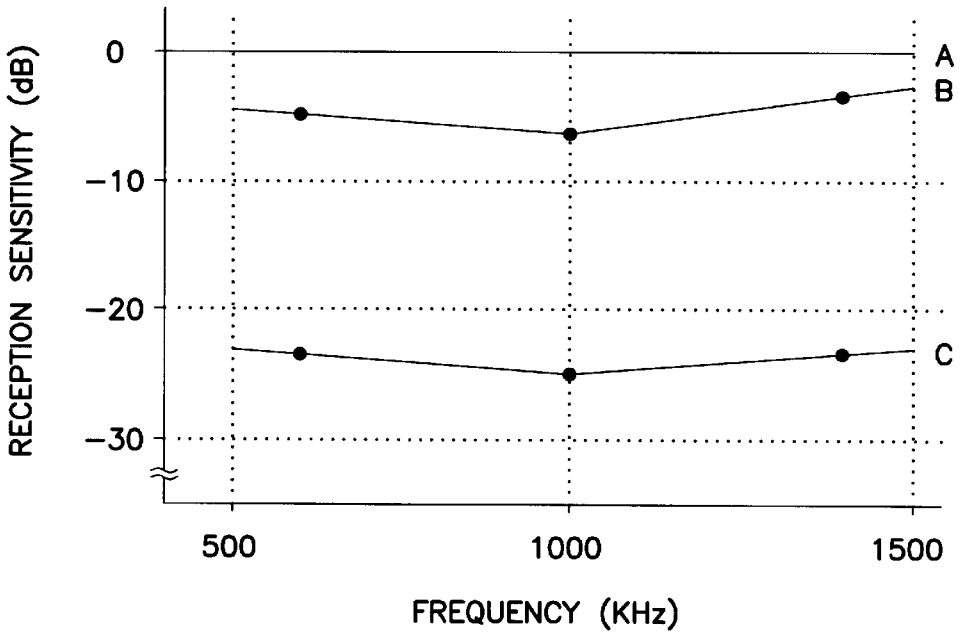
FIG. 5 is a graph showing the frequency vs. reception sensitivity characteristics of the window glass antenna device and other window glass antenna devices.

FIG. 5 shows the frequency vs. reception sensitivity characteristics of the window glass antenna device 1 and other window glass antenna devices.

Figure 1:
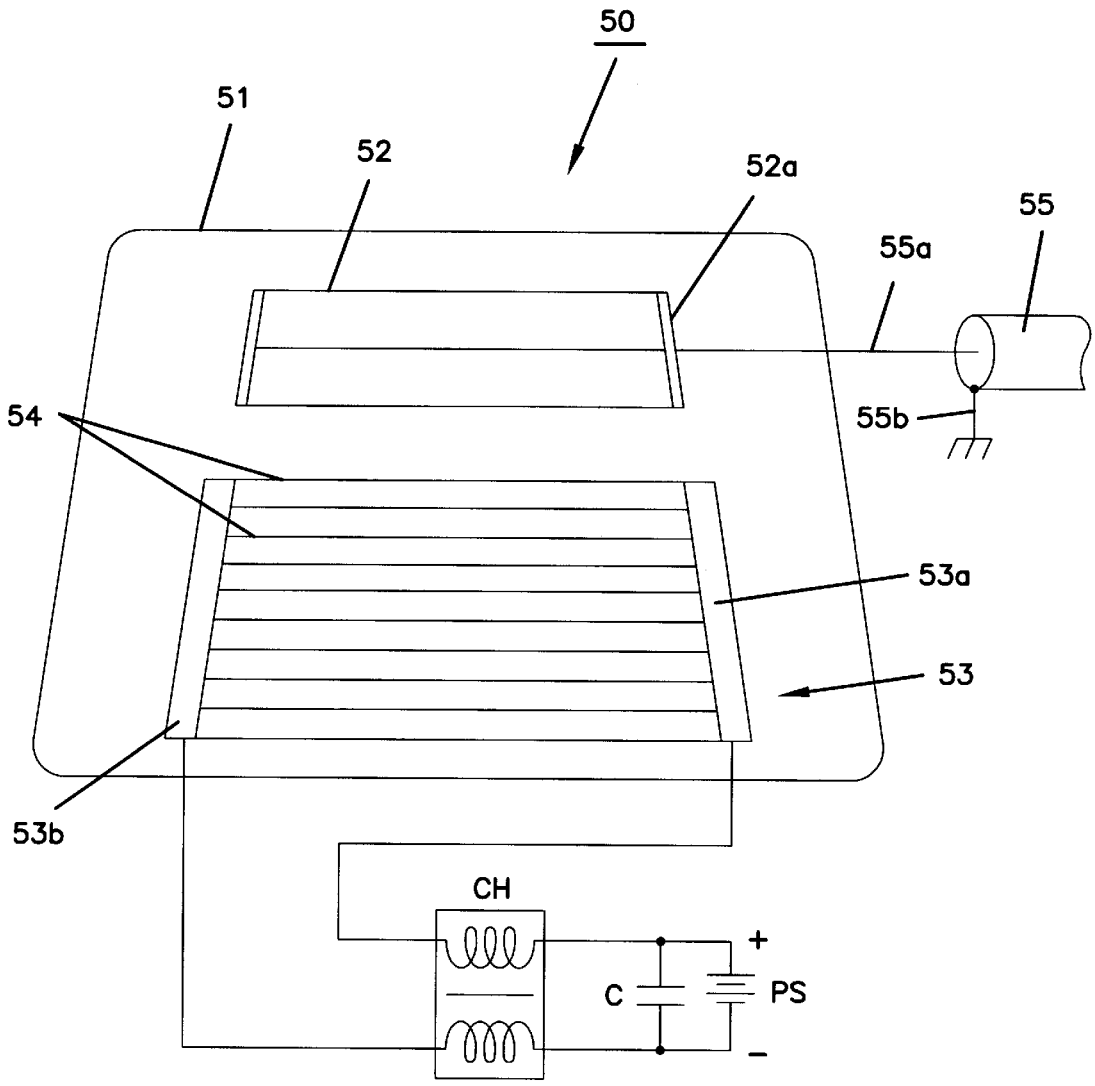
FIG. 1 (PRIOR ART)
FIG. 1 is a schematic plan view of a conventional window glass antenna device.

In FIG. 5, the characteristic curve A represents the signal reception sensitivity of the conventional window glass antenna device 50 (see FIG. 1) with the choke coil CH. Though the signal reception sensitivity of the conventional window glass antenna device 50 actually has various levels at respective frequencies, the signal reception sensitivity is shown as a level 0 dB throughout the entire frequency band to facilitate comparison with other signal reception sensitivities.

The characteristic curve B represents the signal reception sensitivity of the window glass antenna device 1 (see FIG. 2) according to the present invention. While the characteristic curve B shows slight sensitivity reductions (−3.5~6.3 dB) from the characteristic curve A in the AM frequency band, the signal reception sensitivity of the window glass antenna device 1 is of levels which are free of practical problems.

The characteristic curve C represents the signal reception sensitivity of a window glass antenna device which has no impedance transformer unit. The characteristic curve C shows substantial sensitivity reductions (−23.4~25.2 dB) from the characteristic curve A in the AM frequency band.

FIG. 5 does not show the signal reception sensitivities of the window glass antenna devices in the FM frequency band because they are not affected if the choke coil is removed.

The window glass antenna device I which incorporates the impedance transformer unit 7 instead of a choke coil can thus attain a signal reception sensitivity which is free of practical problems.

Figure 6:
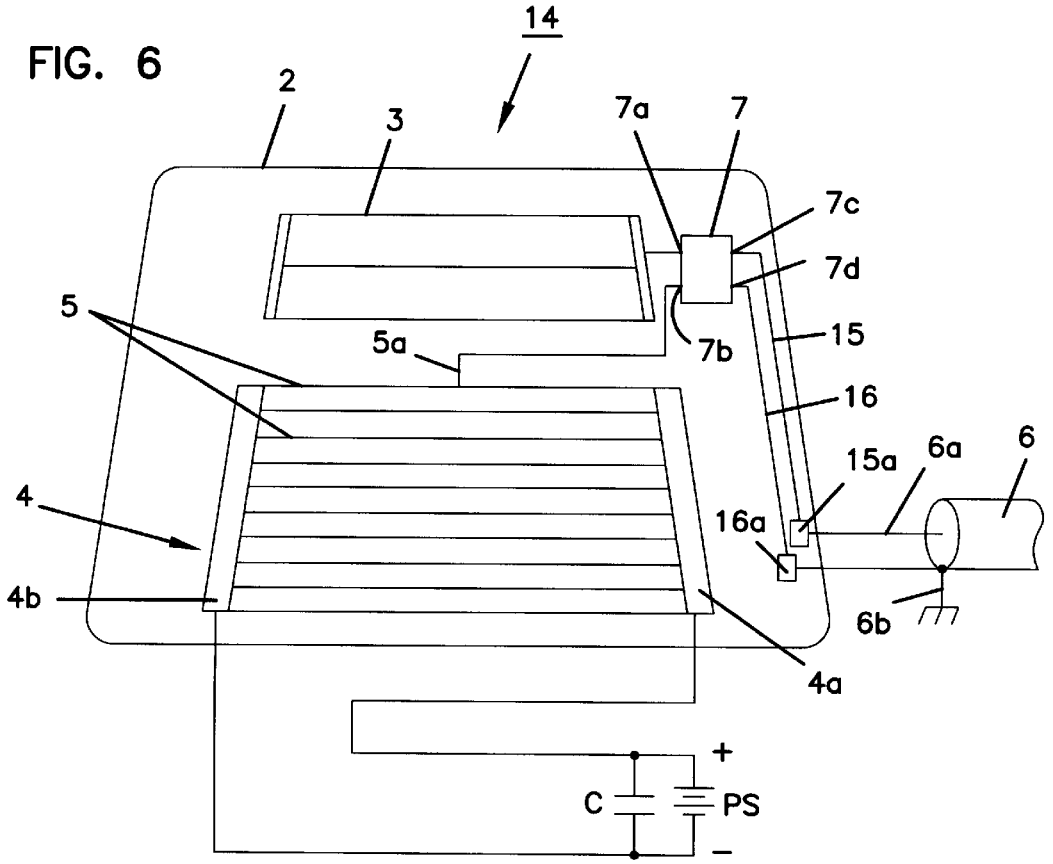
FIG. 6 is a schematic plan view of a window glass antenna device according to another embodiment of the present invention.

FIG. 6 shows a window glass antenna device 14 according to another embodiment of the present invention.

As shown in FIG. 6, the window glass antenna device 14 is similar to the window glass antenna device 1 shown in FIG. 2 except that the terminals 7*c*, 7*d* connected to the secondary winding of the impedance transformer unit 7 are connected to a pair of respective feeder lines 15, 16 which extend downwardly along a side edge of the window glass panel 2 to a lower position thereon, and the feeder lines 15, 16 are connected to respective feeder terminals 15*a*, 16*a* coupled through a coaxial cable (not shown) to the core 6*a* and outer conductive tube 6*b* of the feeder cable 6 for transmitting received signals to an external receiver which is connected to the feeder cable 6.

The feeder lines 15, 16 are employed in situations where the feeder cable 6 cannot be connected to an upper position on the window glass panel 2, but should be connected to a lower position on the window glass panel 2 for being supplied with received signals, due to structural limitations posed by the automobile or the window glass panel 2.

Each of the feeder lines 15, 16 comprises a conductive pattern whose width should preferably be set to 3–5 mm, for example, in order to minimize a transmission loss which is caused to received signals by the feeder lines 15, 16 themselves.

The distance between the feeder line 16 and the bus bar 4*a* should preferably be set to 3~5 mm to prevent the feeder line 16 from contacting the adhesive by which the bus bar 4*a* is bonded to the window glass panel 2. If there is no danger of contact between the feeder line 16 and the adhesive, then the distance between the feeder line 16 and the bus bar 4*a* may be set to a smaller value of 2 mm, for example.

As described above, the window glass antenna devices 1, 14 according to the present invention have the impedance transformer unit 7 comprising the impedance transformer 8 for effecting an impedance conversion between the dedicated antenna 3 and the defroster heater lines (heater antenna) 5, and the feeder cable 6 to reduce a transmission loss of received signals, and combining received signals from the dedicated antenna 3 and the defroster heater lines (heater antenna) 5 to increase a signal level for higher signal reception sensitivity.

Although there have been described what are at present considered to be the preferred embodiments of the invention, it will be understood that the invention may be embodied in other specific forms without departing from the essential characteristics thereof. The present embodiments are therefore to be considered in all respects as illustrative, and not restrictive. The scope of the invention is indicated by the appended claims rather than by the foregoing description.

What is claimed is:

1. A window glass antenna device comprising:

an automobile window glass panel;

a dedicated antenna printed on the automobile window glass panel;

a heater antenna comprising a defroster heater pattern disposed on the automobile window glass panel;

a feeder cable for transmitting receiving signals from said dedicated antenna and said heater antenna; and an impedance transformer for effecting an impedance conversion between said dedicated antenna and said heater antenna, and said feeder cable, said feeder cable having a core and an outer conductor, said impedance transformer comprising a primary winding having a first end connected to said dedicated antenna, said primary winding having a tap connected to said heater antenna, and a secondary winding having a first end connected to said core of said feeder cable, said primary and secondary windings having second ends connected in common with said outer conductor of said feeder cable.

2. A window glass antenna device according to claim 1, further comprising a DC-blocking capacitor connected between said tap and said heater antenna.

3. A window glass antenna device according to claim 1, wherein said impedance transformer comprises a toroidal core of ferrite, said primary winding comprising a predetermined number of turns wound on said toroidal core, said secondary winding comprising a predetermined number of turns wound on said toroidal core.

4. A window glass antenna device according to claim 1, wherein the ratio of the number of turns of said primary winding to the number of turns of said secondary winding is 4:1.

5. A window glass antenna device according to claim 4, wherein said primary winding has an opposite end connected to said secondary winding, and the ratio of the number of turns of said primary winding between said end thereof and said tap to the number of turns of said primary winding between said tap and said opposite end is 15:1.

6. A window glass antenna device according to claim 5, further comprising a DC-blocking capacitor connected between said tap and said heater antenna.

7. A window glass antenna device according to claim 1, further comprising a pair of feeder lines extending from said secondary winding along a side edge of said automobile window glass panel and connected to said feeder cable.

* * * * *